US006089050A

United States Patent [19]

Piceni et al.

[11] Patent Number: 6,089,050

[45] Date of Patent: Jul. 18, 2000

[54] ANTITWIST DEVICE FOR CIRCULAR KNITTING MACHINES WITH MEANS FOR PREVENTING THE FORMATION AND/OR FOR REMOVING ACCUMULATIONS OF WASTE

[75] Inventors: Mauro Piceni; Rolando Furlani, both of Castiglione Delle Stiviere, Italy

[73] Assignee: Golden Lady S.p.A., Ancona, Italy

[21] Appl. No.: 08/946,595

[22] Filed: Oct. 7, 1997

[30] Foreign Application Priority Data

Oct. 8, 1996 [IT] Italy ..... FI96A0235

[51] Int. Cl.[7] ..... D04B 35/32

[52] U.S. Cl. ..... 66/168; 66/149 S

[58] Field of Search ..... 66/168, 150, 149 H, 66/152, 153, 149 S; 15/21.1, 88.1, 88.2, 3, 330.1, 301, 316.1

[56] References Cited

U.S. PATENT DOCUMENTS

| | | | |
|---|---|---|---|
| 309,820 | 12/1884 | Cooper | 66/168 |
| 2,436,241 | 2/1948 | Wytovich | 66/168 |
| 2,522,183 | 9/1950 | Lawson | 66/168 |
| 2,538,659 | 1/1951 | Sharp | 66/168 |
| 3,550,403 | 12/1970 | Shields | 66/150 |
| 5,284,033 | 2/1994 | Lonati et al. | 66/150 |
| 5,560,225 | 10/1996 | Salucci | 66/149 S |

*Primary Examiner*—John J. Calvert
*Assistant Examiner*—Larry O. Worrell, Jr.
*Attorney, Agent, or Firm*—McGlew and Tuttle, P.C.

[57] ABSTRACT

The antitwist device for circular knitting machines comprises a perforated tube (15E) rotating with the needle cylinder (1) of the knitting machine and a fixed outer tube (15A) essentially coaxial with the perforated tube (15E), inside which is generated a vacuum through a side air connection (15D), a space being defined between said perforated tube (15E) and the outer tube (15A). Inside this space, there is at least one cleaning element (45) attached to an actuator device (43) that moves the cleaning element into contact with the outer surface of the perforated tube (15E).

6 Claims, 2 Drawing Sheets

ANTITWIST DEVICE FOR CIRCULAR KNITTING MACHINES WITH MEANS FOR PREVENTING THE FORMATION AND/OR FOR REMOVING ACCUMULATIONS OF WASTE

FIELD AND BACKGROUND OF THE INVENTION

Circular machines for knitting tubular articles such as socks, stockings, tights and the like generally include an antitwist mechanism for ensuring that the article—which rotates with the cylinder during its manufacture and is generally kept in tension by a stream of air generated by a vacuum source—does not become twisted by coming into contact with nonrotating parts of the machine. These mechanisms generally comprise an at least partly perforated tubular element situated directly underneath and coaxial with the cylinder, with which it rotates, and situated inside a tube which is coaxial with it but fixed; said fixed tube possesses a side air connection. During the knitting of the sock or stocking, an arrangement of valves and suitable sealing systems between the perforated element and said outer tube keeps a vacuum source in communication with said side connection, in such a way that a stream of air comes from the needle cylinder and passes centrifugally through the perforations of said tubular element. In this way the stream of sucked air, which in the cylinder keeps the fabric taut, holds the article inside said rotating perforated element as the fabric is formed, so preventing it from becoming twisted. When knitting is completed, said arrangement of valves is used to close the side connection and open the communication between said vacuum source and an axial connection located at the base of the mechanism, in order to remove the article axially from the perforated tubular element and discharge it from the machine.

It frequently happens during fabric manufacture that the processing of the article is interrupted; the causes are numerous and have to do with the yarns used or with possible mechanical trouble. When such a situation arises, action must be taken to restart the production cycle and prepare the machine to commence a new cycle. This operation involves expelling the interrupted article and causes a shower of unknitted strands or filaments (a "reject" as it is known). During this operation one or more of these unknitted strands may enter one of the holes of the partly perforated tubular element. This will create a base for other strands to become caught, so encouraging the formation of a significant obstruction that could even appreciably reduce the cross section of the perforated tube. This can also happen on a machine with the cylinder not rotating. This phenomenon causes considerable problems, in particular:

1) the passage of the article through the perforated tube is inhibited or made difficult, sometimes preventing its expulsion;
2) the optimum rate of flow of air that keeps the fabric of the next article taut is significantly reduced, lowering its quality;
3) during the expulsion there is catching of the fibres of the article on the partial obstructions, which lowers the quality of the fabric (so-called "pulled filaments" occur).

Another common undesirable phenomenon is as follows: during the knitting of the article the perforations of the tubular element are traversed by the stream of air which keeps the article in tension; this stream also entrains fine waste matter from the yarn used in the manufacture of the article, particles of oil, dust and other impurities. These materials tend at least partly to adhere to the holes of the perforations and, over time, cause clogging, rendering the operation of the machine progressively more irregular. Periodical manual cleaning with dismantling of at least part of the device is therefore necessary.

SUMMARY AND OBJECTS OF THE INVENTION

In order to eliminate or reduce the abovementioned problems and/or the need for manual intervention, the present invention provides—in an antitwist device for circular knitting machines, comprising a perforated tube rotating with the needle cylinder of the knitting machine and a fixed outer tube that defines with said perforated tube a space—at least one cleaning element arranged inside said space and attached to an actuator means that moves the cleaning element into contact with the outer surface of said perforated tube.

During predeterminable periods of the operating cycle of the circular machine, the actuator means moves the cleaning element, which may for example be a brush, radially into contact with the outer surface of the perforated tube. The bristles of the brush, or other equivalent members, e.g. a plurality of strips, a deformable covering or the like, pass at least part of the way into the holes of the inner perforated tube and remove any accumulated detritus. The action of the cleaning element may conveniently be synchronized to act, for example, when there is no article in the perforated tube, in order to avoid the risk of damaging the article.

The cleaning element may be rectilinear and approximately parallel to the axis of the perforated tube. Its length may be equal to the entire length of the perforated tube itself, or equal to a fraction thereof. There may be one or more cleaning elements inside the space spaced apart in the circumferential direction and/or also in the axial direction. For example, two or more brushes may be provided at the same level, in order that a rotation of, if desired, a fraction of a complete revolution of the tube will be sufficient to clean the entire circumference. If two or more brushes are spaced apart in the axial direction the entire surface of the tube can be cleaned with brushes of limited length.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
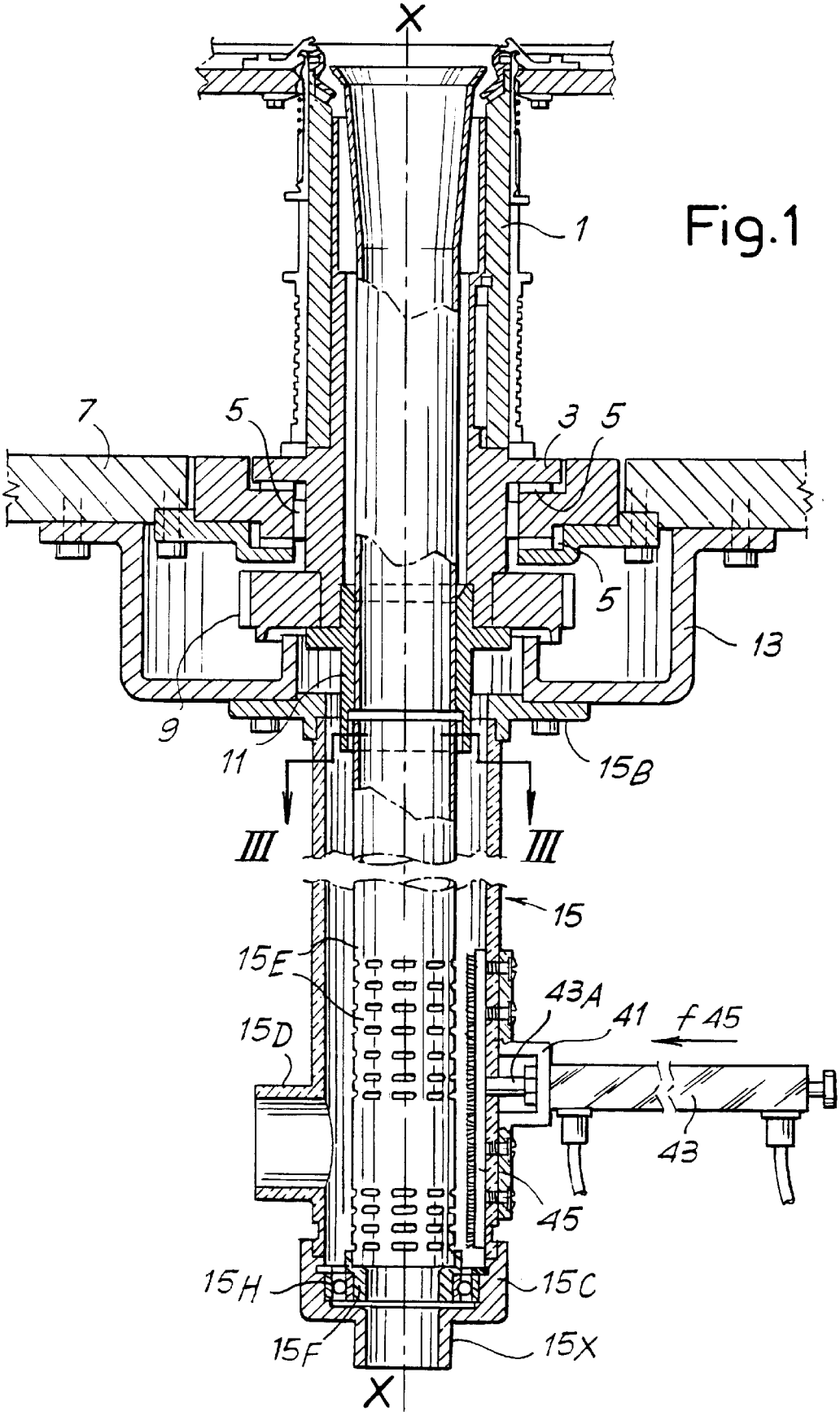
FIG. 1 shows schematically a partial view of a circular machine for making socks and stockings, shown in section on a plane passing down the axis of the cylinder, the machine being fitted with an antitwist mechanism equipped with the device according to the invention.

In a circular machine for making socks and stockings the needle cylinder 1 (FIG. 1) is fixed to a cylinder carrier 3 which is supported rotatably on bearings 5 by the fixed structure of the machine, in particular by the base plate 7. Also fixed to the cylinder carrier 3 are a gearwheel 9, which takes its rotary motion from a motor—via a transmission (not shown)—in order to turn the cylinder 1, and a bush 11 coaxial with the cylinder, its lower end passing down through an opening in the centre of a casing 13 fixed to the underside of the base plate 7.

Figure 2:
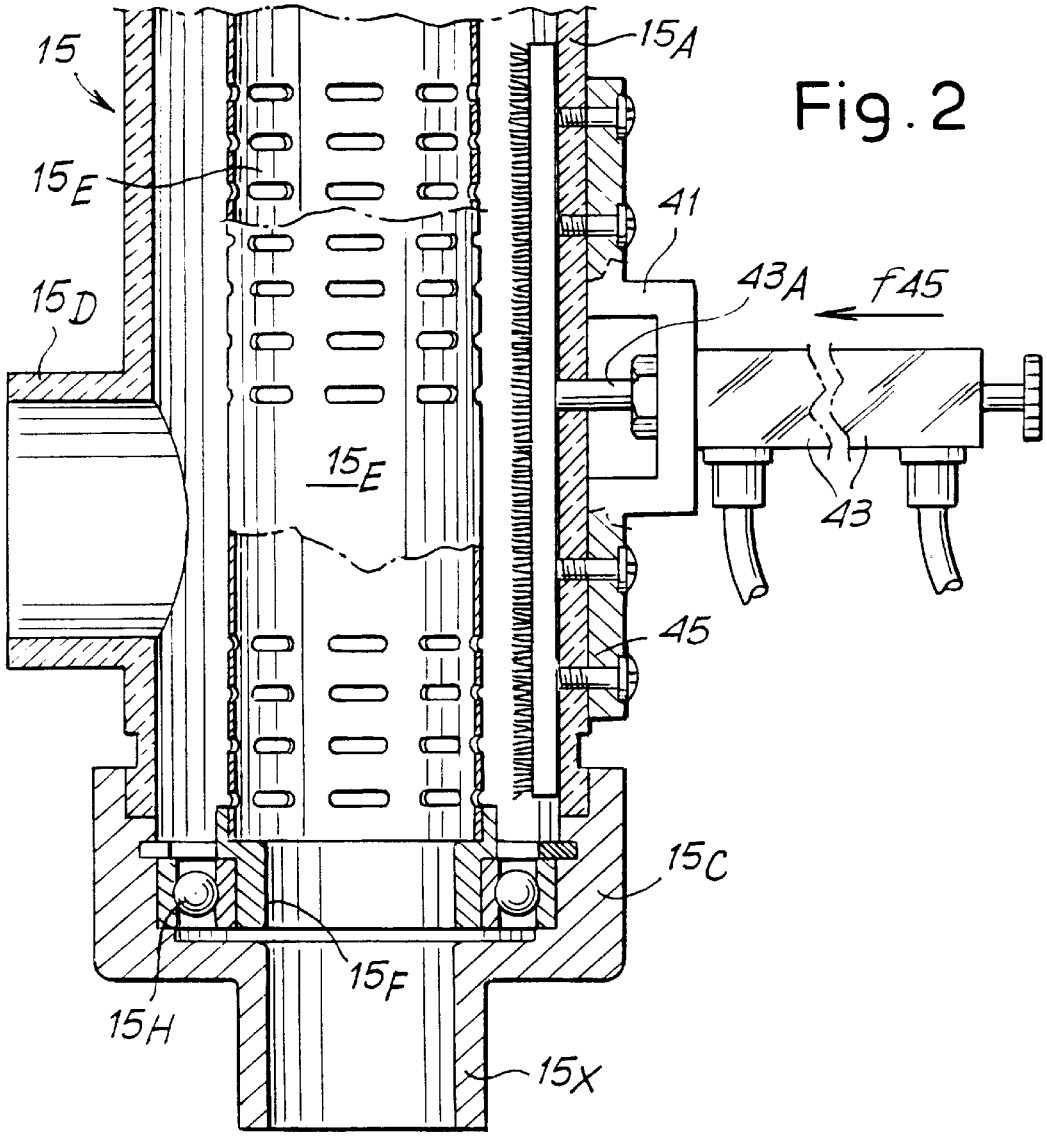
FIG. 2 shows an enlarged detail from FIG. 1 comprising said antitwist device.
Figure 3:
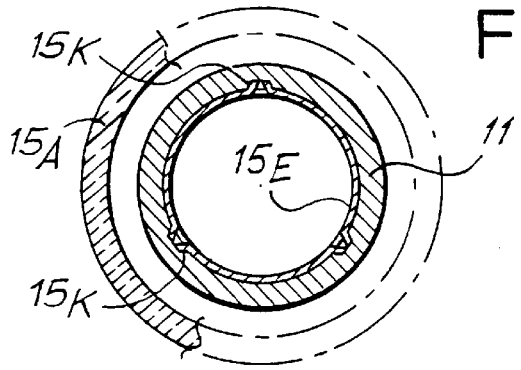
FIG. 3 shows a section on a horizontal plane marked III—III in FIG. 1.

Arranged beneath the casing 13 is an antitwist mechanism 15. Said mechanism comprises an outer tube 15A (FIG. 2) coaxial with the needle cylinder 1. An upper flange 15B and a lower flange 15C are fixed to the respective ends of the tube 15A by adhesive bonding or other means; the lower flange 15C has a central axial opening on the underside of which is a first short nozzle 15X. The tube 15A has a side connection 15D in the form of a second short nozzle close to the lower flange 15C. Either nozzle 15X, 15D can be connected to an air suction system. Inside the tube 15A the mechanism comprises a partly perforated tube 15E whose lower end is fixed, by means of a bush 15F, in a bearing 15H inserted in the lower flange 15C; the upper end of the perforated tube 15E is fixed in the lower end of the bush 11 and comprises (FIG. 3) three outward radial projections 15K which sit in respective internal slots in said bush 11; the needle cylinder 1 consequently causes the perforated tube 15E to rotate via said intermediate bush 11. The perforations of the inner tube 15E extend generally over the entire tube 15A except for the region level with the side connection 15D.

The antitwist mechanism 15 is connected, by tubes and a system of valves (neither being shown), to a vacuum source such as an electric vacuum pump forming part of the circular machine itself or a centralized vacuum line serving the machine room of the hosiery factory; in particular said tubes are connected to the nozzles 15X and 15D of the device. During the knitting of the sock or stocking, said system of valves opens the connection with the vacuum source through the side connection 15D so that the stream of air sucked in from the cylinder 1 passes through the perforations of the tube 15E towards the space between the tube 15A and the perforated element 15E. The knitted fabric gradually forming inside the cylinder is thus kept in tension and tends to cling to the inside surface and accumulate inside the rotating perforated tube 15A without coming into contact with non-rotating parts and therefore without becoming twisted. When the article is finished and removed from the needles, the connection with the vacuum source through the side air connection 15D is closed and the connection with the same source through the lower nozzle 15X is opened in order to remove the article from the machine by pneumatic transport.

At the lower end of the device a supporting bracket 41 is attached to the outer tube 15A. Fixed to the former is a cylinder-and-piston actuator 43 on the outside of the tube 15A. Fixed to the rod 43A of the cylinder-and-piston actuator 43 is a rectilinear brush member 45 parallel to the generatrices of the partly perforated tube 15E. The brush 45 can be pushed against the outer surface of the perforated tube 15E with a movement in the direction of arrow f45 effected by the actuator 43. When the brush 45 is in contact with the tube 15E it cleans it by removing any accumulations of waste or other impurities. An appropriate shaping of the holes, e.g. elongate in the circumferential direction as illustrated schematically for a portion of the tube in FIG. 2, it is possible to achieve a more efficient action of the brush 45.

The brush can be advanced at suitable moments during the operating cycle, in order, for example, to avoid having the bristles of the brush 45 damage the growing article which is clinging to the inner wall of the tube 15E.

The length of the brush 45 need not be that illustrated in the drawing and may actually extend the full height of the tube 15E.

A scraping element of suitable softness may be used instead of a brush.

For more efficient, faster cleaning a plurality of brushes can be arranged around the axis of the tube 15E.

It will be understood that the drawing shows only an example purely as a practical demonstration of the invention, it being possible for said invention to be varied in its shapes and arrangements without thereby departing from the scope of the concept underlying the invention. The presence of any reference numerals in the accompanying claims is for the purpose of facilitating the reading of the claims with reference to the description and drawing, and does not limit the scope of protection represented by the claims.

What is claimed is:

1. An antitwist device for circular knitting machines with a rotating needle cylinder, the device comprising:

a perforated tube rotating with the needle cylinder;

a fixed outer tube substantially coaxial with said perforated tube, said outer tube including an air connection for generating a vacuum inside said outer tube, said perforated tube and said outer tube defining a space between said perforated tube and said outer tube;

a cleaning element arranged in said space between said perforated tube and said outer tube, said cleaning element being attached to an actuator for moving said cleaning element into contact with an outer surface of said perforated tube.

2. The device as claimed in claim 1, wherein:

said cleaning element is a brush.

3. The device as claimed in claim 1, wherein:

said cleaning element is substantially rectilinear and substantially parallel to a longitudinal axis of said perforated tube.

4. The device as claimed in claim 1, wherein:

said perforated tube defines a plurality of circumferentially elongate holes.

5. The device as claimed in claim 1, wherein:

said perforated tube has a hole area defining a plurality of circumferentially elongate holes;

said cleaning element is movable into contact with said hole area.

6. The device-as claimed in claim 1, wherein:

said actuator is a cylinder-and-piston actuator arranged on an outside of said outer tube and moves said cleaning element at substantially right angles to a longitudinal axis of said outer tube.

* * * * *